United States Patent [19]

Marquet

[11] Patent Number: 4,627,766

[45] Date of Patent: Dec. 9, 1986

[54] MULTI-PURPOSE MARINE BARRIER SYSTEM

[76] Inventor: Maurice C. Marquet, 2188 Oakridge Crescent, R.R. #5, Abbotsford, British Columbia, Canada, V2S 4N5

[21] Appl. No.: 840,413

[22] Filed: Mar. 13, 1986

[51] Int. Cl.[4] ..... E02B 17/00

[52] U.S. Cl. ..... 405/195; 405/218; 405/60; 160/108; 40/617

[58] Field of Search ..... 405/218, 219, 220, 221, 405/195, 60; 40/617, 215; 160/108, DIG. 11; 114/219, 240 B, 240 C, 240 D, 240 E; 52/38

[56] References Cited

U.S. PATENT DOCUMENTS

| | | | |
|---|---|---|---|
| 1,206,141 | 11/1916 | Reynolds | 160/DIG. 11 |
| 1,270,656 | 6/1918 | Pedo | 160/DIG. 11 |
| 2,746,257 | 5/1956 | O'Brien | 405/211 |
| 3,599,434 | 6/1969 | Missud | 405/195 |
| 3,695,209 | 10/1972 | Giese | 114/230 |
| 3,984,987 | 10/1976 | Light, Jr. | 405/63 |
| 4,089,767 | 5/1978 | Sabins | 204/197 |
| 4,135,467 | 1/1979 | Loire et al. | 114/219 |
| 4,289,423 | 9/1981 | Mougin | 405/61 |
| 4,416,073 | 11/1983 | Vicino et al. | 40/326 |
| 4,525,946 | 7/1985 | Olson | 40/514 |

FOREIGN PATENT DOCUMENTS 1370369 10/1974 United Kingdom .

*Primary Examiner*—Dennis L. Taylor

*Assistant Examiner*—Kristina I. Hall

*Attorney, Agent, or Firm*—Hughes & Cassidy

[57] ABSTRACT

A barrier system for concealing unsightly piles (11) and similar supports used to support a waterfront structure such as a dock (10) and for converting the vertical plane outboard of the piles (11), above the waterline (12), and below the waterfront structure (10), to utilitarian space for the display of graphic media. In one embodiment of the invention, the barrier system comprises a dynamic system wherein the barrier moves upwardly and downwardly with incoming and outgoing tides and includes a fine stainless steel mesh screen (14) secured at it's upper end to a roller (15) mounted on support brackets (16, 18) secured to the dock (10) and at it's lower end to a rod (20) having eyelets (21) projecting from it's opposite ends. Cables (22) secured at their upper ends to the brackets (16, 18) extend through the eyelets (21) and are anchored in place by weights (W-1, W-2). The screen (14) is maintained in a state of bouyant balance by flotation gear (25) secured to the rod (20), a weight (W-4) secured to the flotation gear (25), and a second weight (W-3) secured to and trained about a pulley (26) mounted on and drivingly connected to roller (15) so that the balancing system (25, W-3, W-4) serves to roll the screen (15) upwardly on incoming tides and downwardly on outgoing tides. In other disclosed embodiments of the invention, both dynamic and static barrier systems are described for use at waterfront locations where the waterline (12) remains substantially constant.

22 Claims, 7 Drawing Figures

MULTI-PURPOSE MARINE BARRIER SYSTEM

BACKGROUND OF THE INVENTION

1. The present invention relates generally to barrier systems having particular utility in connection with unsightly marine environments; and, more particularly, to a dynamic barrier system that may readily be installed on a dock, pier and at similar waterfront structures supported by conventional unsightly piles or the like. More specifically, the invention relates to a barrier system employing a stainless steel fine mesh screen—sometimes referred to as "wire cloth"—or, alternatively, a mesh screen made of other material characterized by its durability and imperviousness to water damage, which can be suspended on a roller from the structure supported by the piles and which hangs down to the waterline so as to provide a fine mesh barrier covering the unsightly support structure and which, for all practical purposes, conceals the unsightly structure. Such fine mesh screens are of the type that while air may freely pass therethrough, they effectively conceal whatever is positioned behind the screen from the vision of anyone other than one immediately adjacent the screen. Moreover, fine mesh screens of the foregoing type readily adapt themselves to the application of both written, pictorial and/or decorative materials—hence, the screen concealing the unsightly structure can be used for advertising purposes and/or simply for purposes of beautification of the waterfront.

The present invention finds advantageous application at virtually any type of waterfront, be it a tidal basin or the like, or a lakefront where the level of the water is relatively constant. Thus, in the case of a tidal waterfront where the level of the water may vary significantly between high and low tides—in some cases, tidal variations may be up to 20′, or more—the invention permits the use of a mesh screen barrier terminating at its lower end in flotation gear together with means actuated by tidal changes for rolling the screen up and down as the tide comes in and goes out. Consequently, such an arrangement provides a dynamic barrier screen display mechanism which is characterized by continuing changes in the visual portion of the promotional, pictorial and/or other decorative media formed on the barrier.

On the other hand, when used at lakefront properties or the like where there is no appreciable change in water level, the mesh screen may be a fixed stationary screen capable of static display of promotional, pictorial and/or decorative media; or, alternatively, the screen may be a continuous screen trained over: (i) a first horizontally disposed roller at the level of the pier or other structure supported by the unsightly piles; and (ii), around a second horizontally disposed roller supported from the piles at the waterline. Thus, rotation of one or the other of the rollers by means of a drive motor serves to slowly rotate the barrier screen to provide a constantly changing visual scene ccmprising promotional, pictorial and/or decorative materials.

2. Background Art

Waterfront property has traditionally been viewed as highly desirable property having both aesthetically pleasing and utilitarian characteristics. As such, there is, and for some time there has been, a real need for some way to enable merchants who cater to those who frequent the waterfront to promote their wares and/or services in an effective manner that will add to the beauty and aesthetic appearance of such property without, in any way, detracting therefrom. Such property is commonly frequented by boaters and like individuals who, unlike land-based individuals, have the opportunity of viewing the waterfront from an off-shore location. As is well known, waterfront property is at a premium and all types of recreational and business structures will be found built as closely as possible to, and often overhanging, the water's edge—structures ranging from: marinas; to wharfs, piers or docks used for both pleasure and/or commercial purposes; to luxury hotels; offices; etc. As a general rule, such structures will be supported on piles which are firmly and permanently bottomed on bedrock or other fixed subterranean earth structure beneath the surface of the water. Unfortunately, even when first installed, such piles are unsightly and severely detract from the beauty of the waterfront, particularly when viewed from off-shore. Moreover, such piles tend to capture and retain all types of unsightly flotsam. And, of course, they further tend to amass barnacles, sea weed and similar unsightly marine growths.

Prior to the advent of the present invention, the space occupied by such marine piles has not only been characterized by its unsightly nature detracting from the beauty of the waterfront, but, moreover, the space has served no utilitarian function. Yet, those marinas or other businesses on the waterfront which cater to boaters and the like are always seeking ways and space to promote their business activities. Indeed, on occasion—for example, EXPO '86 which will take place on the waterfront in Vancouver, British Columbia—companies engaged in the sale of consumer products and/or services find that there is a real shortage of available advertising space where they can display their wares and/or services to the consuming public. Insofar as is known, it has not previously been suggested that either dynamic or static mesh screens can be employed to perform a dual function on the waterfront viz., (i) to conceal unsightly piles and related support structures; and (ii), at the same time, to provide an area having desirable utilitarian functions such as display space for promotional materials and/or space for pictorial or decorative displays that enhance the natural beauty of the shoreline.

However, the use of various types of screens, per se, in connection with docks, stationary piers, floating piers and the like is well known. For example in U.S. Pat. No. 2,746,257-O'Brien, the patentee has disclosed the use of a fire wall which can be mounted on the pier in overlying relation to the piles that support the pier. Similarly, in U.S. Pat. No. 4,135,467-Loire, et al, the patentees disclose the use of a heavy mesh net which serves to protect the support piles-particularly those employed with an off-shore oil rig—from damage by ships; while U.S. Pat. No. 3,599,434-Missud discloses a floatable skirt surrounding such an off-shore oil rig to confine inadvertently released oil.

Mougin disloses the use of a mesh type screen for protecting icebergs in U.S. Pat. No. 4,289,423; while a floating barrier is disclosed in U.S. Pat. No. 3,984,987-Light, Jr., for silt and pollution control in a marine facility. Other patents of miscellaneous interest include U.S. Pat. Nos. 4,089,767-Sabins and 3,695,209-Giese which respectively relate to an anode system for cathodic protection of off-shore structures and to vessel mooring devices.

None of the foregoing patent disclosures relate to the provision of a barrier screen for concealing unsightly waterfront support piles; nor do any of such patents relate to a system for converting such unsightly space to utilitarian space capable of displaying promotional materials and/or decorative scenes which beautify the waterfront property and which can provide either dynamic or static displays. However, roller type signs, per se, are known and disclosed in, for example, United Kingdom Patent No. 1,370,369-Reeves; while a waterborne inflatable promotional device is disclosed in U.S. Pat. No. 4,416,073-Vicino, et al.

However, the known prior patented devices simply do not contemplate nor relate to the problems which the present invention set out to overcome and has effectively overcome.

SUMMARY OF THE INVENTION

The present invention overcomes all of the foregoing disadvantages, both aesthetic and utilitarian, which are prevalent at improved waterfront properties and which stem directly from the need to employ unsightly piles to support various types of man made structures by providing a barrier system which readily permits air movement therethrough while simultaneously effectively screening the unsightly piles from visual observation. Moreover, the barrier system significantly increases the availability of utilitarian space for promotional messages and/or decorative scenes serving to beautify the waterfront—messages and/or scenes that can be either dynamic (i.e., continuously changing as a result of either tidal changes or because the barrier is power driven) or static. This is accomplished in one exemplary form of the invention by suspending a stainless steel fine mesh screen or the like capable of carrying visual display media from a roller with the lower end of the screen being supported at the waterline by flotation gear. A suitable system, here in the form of adjustable weights, is provided for biasing the support roller in a first direction to roll the screen upwardly and for simultaneously biasing the flotation gear, and therefore the lower edge of the screen, downwardly toward the waterline with the weights being selected such that the screen is balanced by the flotation gear so that the screen rolls upwardly on the incoming tide and downwardly on the outgoing tide. In an alternative arrangement, having particularly advantageous utility at lakefronts and the like where tidal changes are not a factor, the barrier screen takes the form of a continuous screen trained about a pair of vertically spaced horizontally disposed rollers—one at or immediately above the waterline and the other at the base of the pile supported structure with one such roller being power driven so as to slowly rotate the barrier screen for continuously changing the visually observable display media formed thereon.

DESCRIPTION OF THE DRAWINGS

These and other objects and advantages of the present invention will become more readily apparent upon reading the following detailed description and upon reference to the attached drawings, in which.

Figure 1:
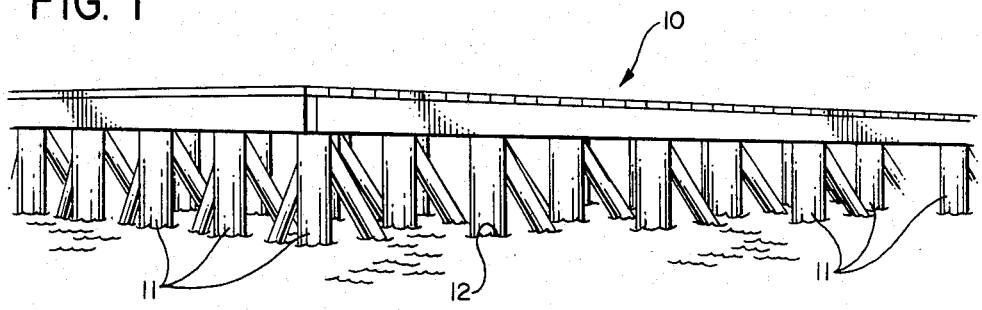
FIG. 1 a fragmentary elevational view from an off-shore vantage point here illustrating a typical waterfront sight at high tide—viz., a portion of a dock or similar structural member supported on a plurality of piles.

While the invention is susceptable of various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents and alternatives falling within the spirit and scope of the invention as expressed in the appended claims.

DETAILED DESCRIPTION

Figure 2:
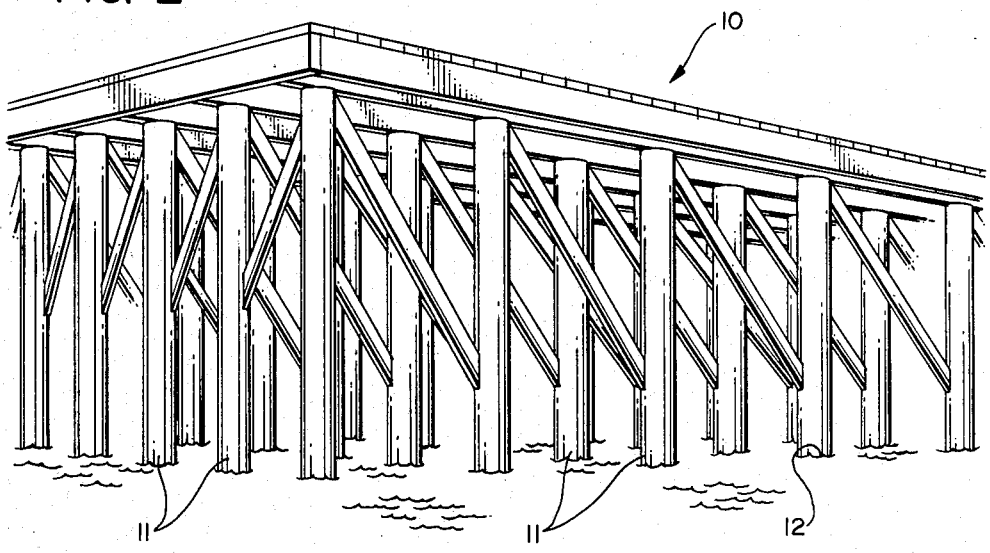
FIG. 2 is a fragmentary elevational view of the same scene depicted in FIG. 1, again from an off-shore vantage point but much closer to the dock than shown in FIG. 1, here depicting the appearance of the dock and its support piles at low tide.

Turning now to the drawings, and directing attention first to FIGS. 1 and 2 conjointly, there has been illustrated in highly diagrammatic fragmentary form, a typical waterfront scene—viz., a pier, dock or similar man-made support structure, generally indicated at 10, which is supported on a plurality of piles 11 above the waterline 12 and in overhanging relation to the water. As here shown, the support structure 10 is depicted as it would commonly appear to a person situated at an off-shore vantage point under high tide conditions in FIG. 1 and at low tide conditions in FIG. 2. That is, in FIG. 1 the waterline 12 is only a few feet from the level of the upper surface of the dock or other structure 10; while in FIG. 2, the waterline 12 may be ten, fifteen, or more feet below the level of the structure 10.

As will be immediately apparent to virtually any sighted individual, the piles 11 present an unsightly appearance under virtually any tidal condition; but, as the tide moves outwardly and more and more of the piles 11 are exposed above the waterline 12, the visual appearance of the overall scene is progressively degraded. And, while not shown in the drawings, it will be understood that the unsightly appearance of the piles 11 will be exacerbated as the piles age, tend to deteriorate, and become repositories and/or breeding places for flotsam, seaweed, barnacles and other types of marine growth. Moreover, those skilled in the art will appreciate that the area outboard of the piles 11 and between the waterline 12 and the level of the dock or other support structure 10 serves no utilitarian purpose whatsoever.

Figure 3:
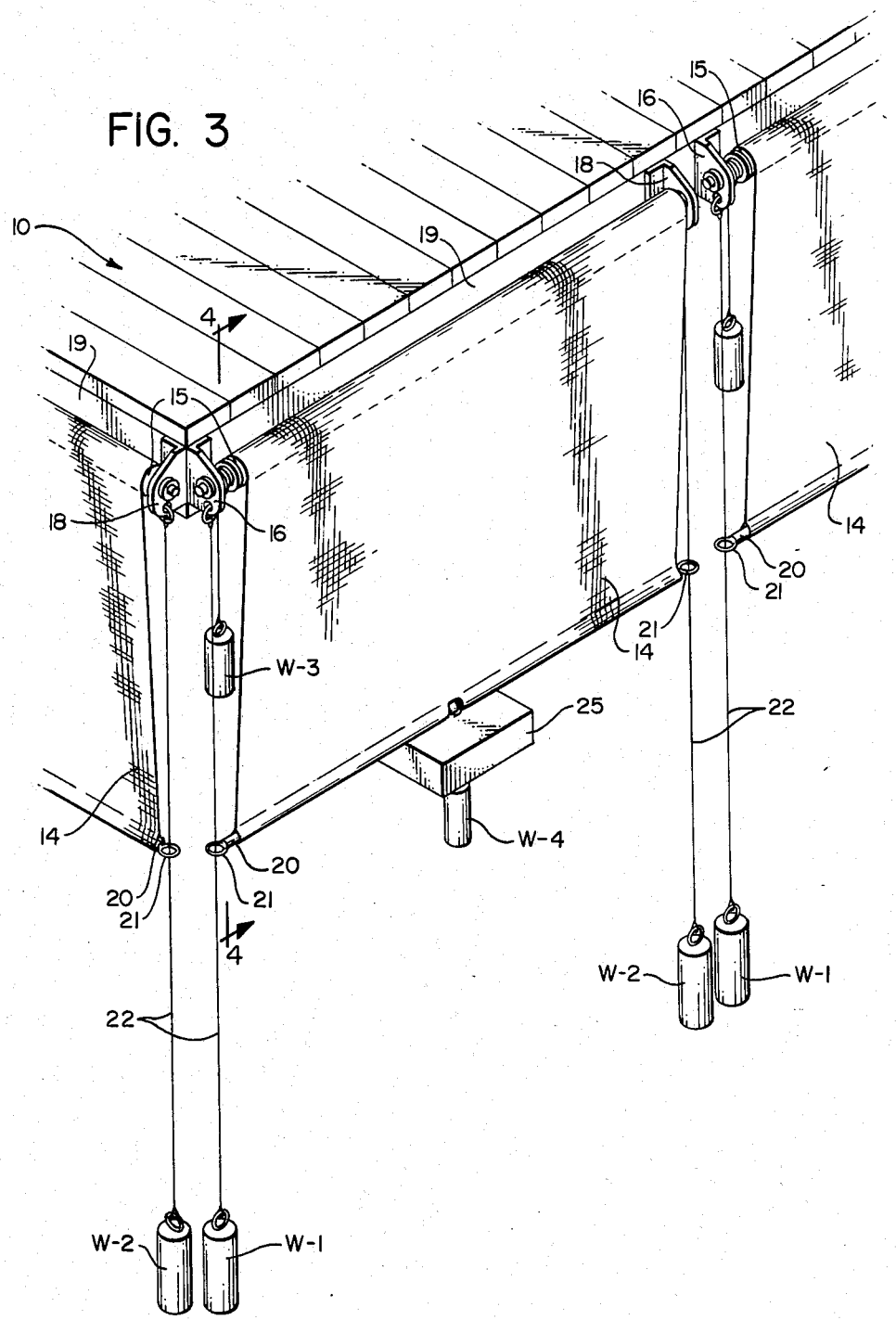
FIG. 3 is a fragmentary perspective view here illustrating details of one exemplary form of the present invention—specifically, the use of a plurality of adjacent fine mesh stainless steel barrier screens which are supported from the edge of the dock and are capable of moving up and down with tidal variations to conceal the support pile structure (not shown in the drawing) which serves to support the dock.
Figure 4:
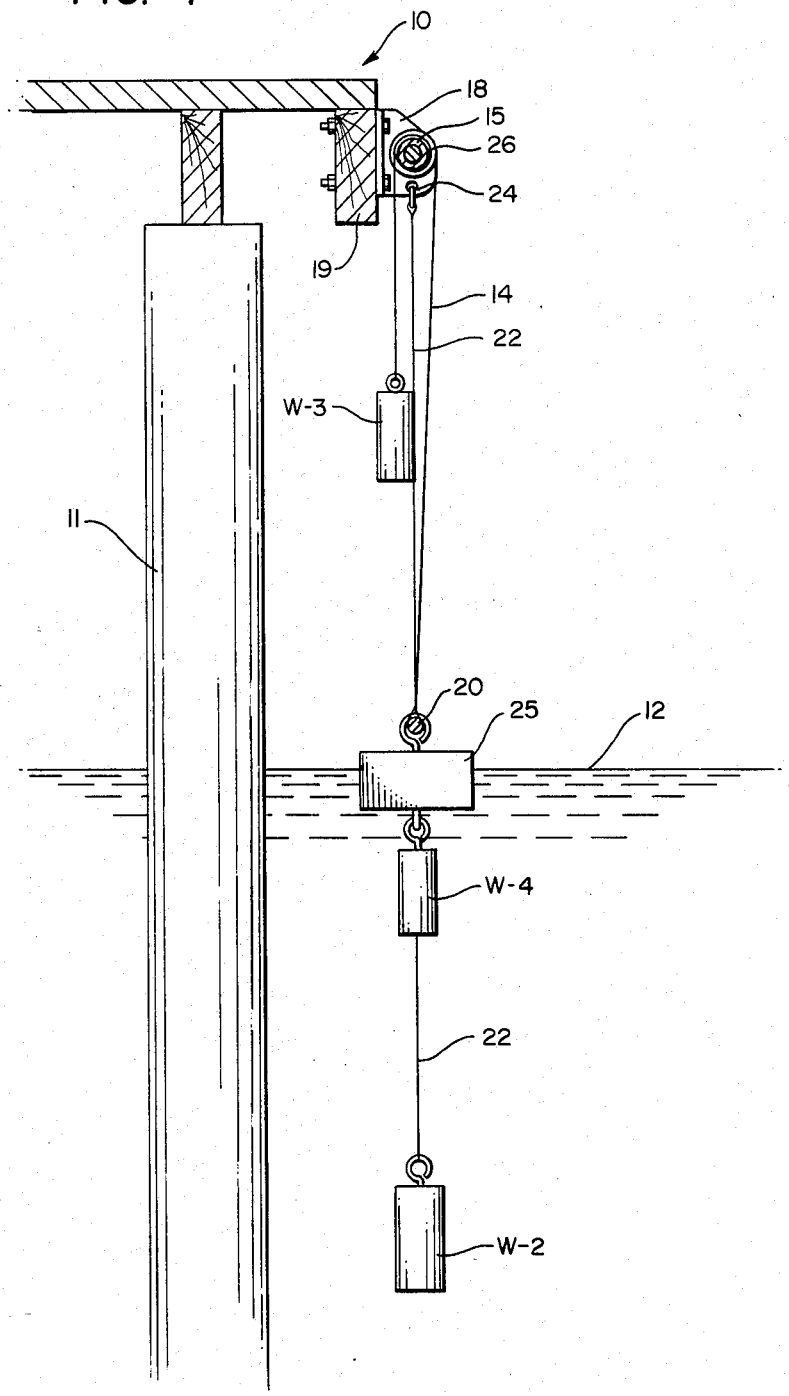
FIG. 4 is a fragmentary vertical sectional view taken substantially along the line 4—4 in FIG. 3, here illustrating details of a typical dock and support pile with one of the barrier screens of the present invention being suspended form the dock for purposes of concealing the unsightly piles while at the same time converting the unused space in front of the piles to utilitarian space.

In accordance with one of the important aspects of the present invention, provision is made for creating a barrier system—preferably, a dynamic barrier system—which serves to conceal the unsightly piles 11 and any other unsightly support structure and/or flotsam beneath the dock 10, while at the same time presenting a visually improved scene upon which printed materials and/or pictorial or decorative scenes can be printed or otherwise affixed that serve to affirmatively beautify the waterfront: and, wherein the barrier system preferably moves with tidal variations so as to create a dynamically changing visible scene and so as to prevent submersion of the barrier screen beneath the waterline 12. To accomplish this, and as best shown by reference to FIGS. 3 and 4 conjointly, one or more fine mesh screens 14 are suspended from the outboard edge of the dock 10 immediately beneath the upper surface thereof on rollers 15. Thus, as here shown, the opposite ends of each roller 15 are journaled for support by, and rotation in, a pair of outwardly projecting brackets 16, 18 which are permanently affixed to the outer edge structure 19 of the dock in any suitable manner such, for example, as by bolts or the like (not shown).

In carrying out the invention, the fine mesh screen 14—a screen which can take any desired form and be made of a wide range of materials which are not subject to water damage, but wherein a fine stainless steel mesh screen of the type commonly referred to as "wire cloth" is especially advantageous—is secured to, and wrapped around, the support roller 15 in the same fashion as a window shade, with the lower or free end of the screen 14 being permanently secured to an horizontally disposed pipe or rod 20 having eyelets 21 projecting from either end thereof. In order to maintain the screen 14 in a fixed vertical plane, any suitable weights W-1, W-2—e.g., concrete blocks or the like on the order of perhaps 200 pounds—are supported by cables 22 which pass through the eyelets 21 and are fixedly secured at their upper ends to the roller support brackets 16, 18, as best illustrated at 24 in FIG. 4. Thus, the weights W-1, W-2 serve as anchors to stabilize the cables 22 and maintain such cables under tension in a fixed vertical plane under virtually all tidal conditions, with the cables 22 serving as guides or tracks to confine the movement of the screen 14 along a fixed vertical path.

In order to permit the screen 14 to move dynamically with changes in tidal levels, the screen is maintained in a state of bouyant balance; and, to this end, the screen 14 is supported by a series of weights and flotation gear which are selected such that the lower edge of the screen 14 is maintained at, or immediately above, the water line 12 at all tidal conditions. To accomplish this, a float 25 is secured to each rod 20 at approximately the mid-point thereof in such an manner that as the tide comes in and the float 25 rises, the lower edge of the screen 14 is permitted to move upwardly; and, conversely, as the tide goes out and the float 25 moves downwardly, the lower edge of the screen 14 is free to move downwardly therewith. In order to maintain the screen 14 and flotation gear in a balanced buoyant state when the float 25 and screen 14 move in unison with, and in the same direction, as, the tidal variation, a first weight W-3 is secured to and trained about a pulley 26 (FIG. 4) mounted on, and drivingly connected to, one end of roller 15 in such a manner as to normally bias the roller 15 in a counterclockwise direction as viewed in FIG. 4—i.e., in a direction tending to roll the screen 14 upwardly onto and about the roller 15; while a second weight W-4 is secured to and suspended from float 25 tending to bias the float, and therefore the screen, downwardly. The two weights W-3, W-4 are selected such that the float 25 is buoyantly balanced at all conditions of tidal variation.

Those skilled in the art, will, of course, appreciate that the particular values of the weights selected will vary dependent upon numerous factors such as, merely by way of example, the buoyancy characteristics of the water, the size of the float 25, and the size and weight of the screen 14. However, given those parameters, it is well within the skill of the art to select values for weights W-3, W-4 such that the screen 14 will automatically roll upwardly about roller 15 on incoming tides and roll downwardly on outgoing tides, thereby constantly and dynamically changing the visibly exposed screen area above the waterline 12 with tidal variations.

Figure 5:
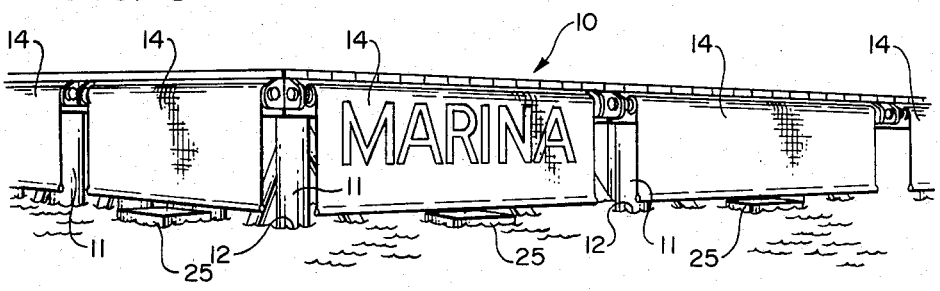
FIG. 5 is a view similar to that shown in FIG. 1, but here illustrating a plurality of fine mesh screens embodying features of the present invention as viewed at high tide from an off-shore vantage point and indicating one type of exemplary promotional display message that can be employed with such a screen.
Figure 6:
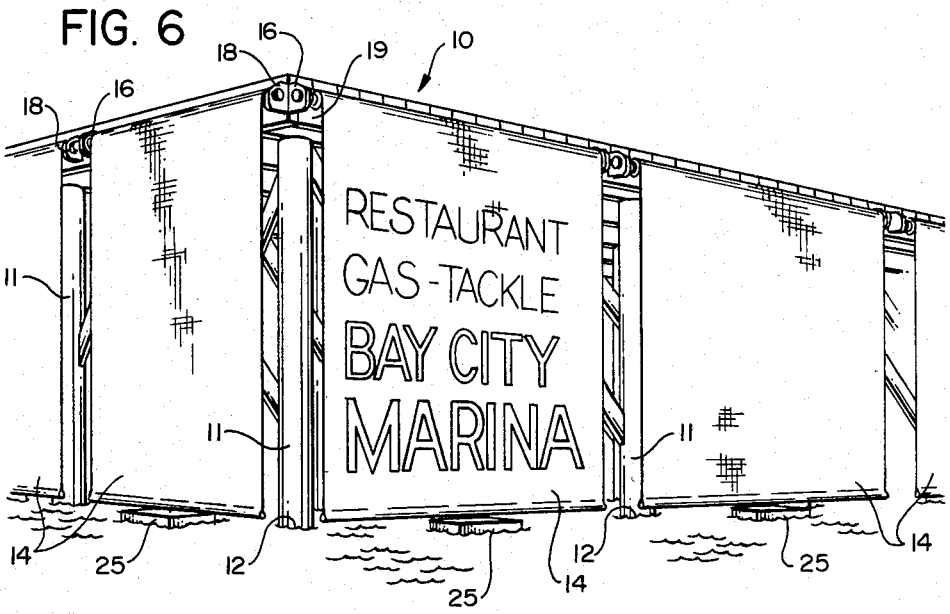
FIG. 6 is a fragmentary elevational view similar to FIG. 2, but here illustrating the barrier screen of FIG. 5 at low tide so as to emphasize the dynamic nature of the messages that can be employed as the water level shifts between high and low tides; and, FIG. 7 is a side elevational view, partly in section, here depicting a slightly modified form of the invention which finds particuarly advantageous application at lakefronts or other shoreline installations where the water level remains constant and is substantially unaffected by tidal variations.

As a consequence of the foregoing arrangement, the dynamic barrier system hereinabove described provides a medium which is advantageously suitable for the display of, for example, advertising or similar promotional materials such as that shown in FIGS. 5 and 6. Thus, it will be appreciated upon inspection of FIG. 6 that the barrier screen 14 has inscribed thereon the messages: "RESTAURANT"; "GAS-TACKLE"; "BAY CITY"; and "MARINA", all of which are visually exposed at low tides, but wherein only the message "MARINA" is visible at high tide as shown in FIG. 5. And, of course, as the tide goes out, the visual message presented and observable will progressively change from "MARINA" as shown in FIG. 5 to "BAY CITY MARINA", to "GAS-TACKLE BAY CITY MARINA", to "RESTAURANT GAS-TACKLE BAY CITY MARINA" at low tide as shown in FIG. 6. Such promotional messages can, of course, be in lettering selected such that the message will be readily visible and legible for considerable distances from the shore—a decided advantage to merchants who cater to boaters.

Moreover, while not shown in the drawings, those skilled in the art will appreciate that the scenes presented on, and dynamically displayed by, the barrier screen(s) 14 need not be only written advertising messages as shown but, rather, the scene can be pictorial or mural-like so as to enhance the beauty of the waterfront; the scenes can be caricatures and or cartoons to instill public interest and/or amuse or to provide some marine related or other warning of interest to the public; and/or, the media inscribed on the screens can be combinations of any two or more of the foregoing.

Those skilled in the art will readily appreciate from the foregoing, particularly upon inspection and comparison of FIGS. 5 and 6 illustrating a typical utilization of the invention with FIGS. 1 and 2 depicting the same visual scene without the barrier screen 14 of the invention, that utilization of such barrier systems readily perform a dual function—viz., (i) the screens serve to effectively conceal unsightly pilings 11 and other support structure and/or flotsam from view; while (ii), at the same time converting heretofore useless space to utilitarian space that can be utilized for visual display of advertising and/or promotional media, and/or which can be employed simply to beautify the waterfront. Because the screens 14 are formed of a relatively fine mesh, not only are the piles 11 and unsightly objects and growths behind the screen effectively concealed but, moreover, the screen readily permits passage of air movement therethrough so as to remain substantially stable—except, of course, for relatively slow vertical upward or downward movement with tidal changes—irrespective of wind conditions.

Figure 7:
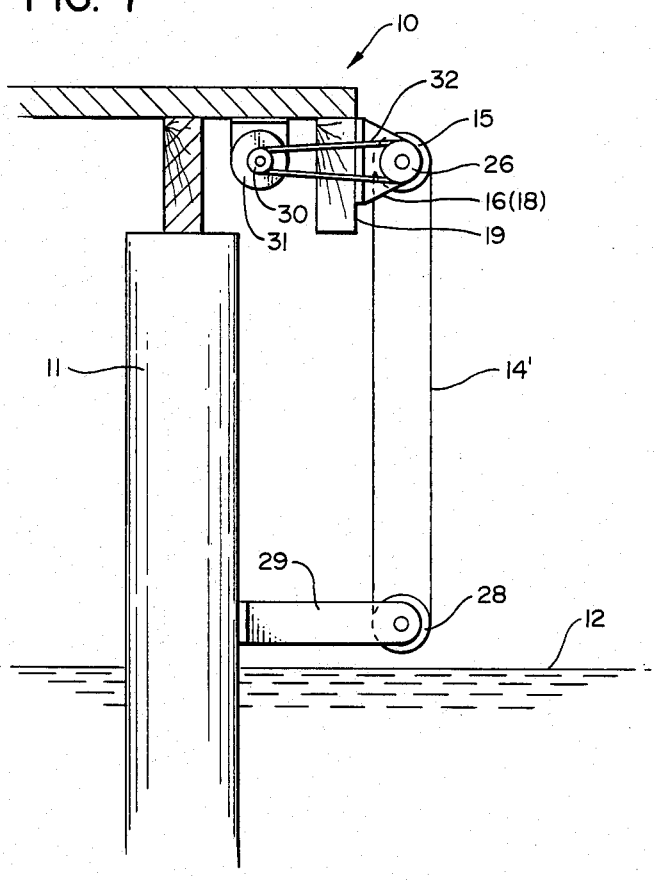

Thus far the exemplary embodiment of the invention has been described in conjuction with utilization at a waterfront location subject to tidal variations. However, in its broader aspects, the invention finds equally advantageous use at marinas, docks and/or other waterfront locations on lakes or similar bodies of water which are not subject to tidal changes or any other significant variations in water levels—for example, a land-locked lakefront. Such an exemplary embodiment of the invention has been depicted in FIG. 7 where like reference numerals have been utilized to designate like structural elements. Thus, as here shown, a fine mesh screen 14' is suspended from a rod 15 mounted on brackets 16, 18 (only bracket 16 is visible in FIG. 7) secured to the outer edge structure 19 of a dock 10 or the like. However, in this exemplary embodiment of the invention, since the waterline 12 remains essentially constant, the fine mesh barrier screen 14' comprises an endless belt-like screen which is trained over upper roller 15 and about a lower roller 28 supported by brackets 29 fixedly secured to the piles 11 or other support structure immediately above the fixed waterline 12. To permit dynamic change of the messages or other visually observable media printed on the screen 14', pulley 26 mounted on roller 15 is coupled to the output shaft 30 of a suitable drive motor 31 by means of a drive belt 32. As a consequence of this arrangement, the motor 31 can be utilized to move the screen 14' in either direction and at any desired speed, either continuously or intermittently, so as to display desired messages and/or scenes to individuals on the water or at land-based locations where the exposed face of screen 14 is visible.

Indeed, those skilled in the art will appreciate that the screen 14' can, if desired, be replaced with a stationary screen (not shown) fixedly attached at it's upper end to a rod or other fixed support secured to brackets 16, 18 and at it's lower end to a similar rod or other fixed support carried by brackets 29. In this instance, while the mesh screen remains stationary, the barrier system of the invention continues to serve the dual function of concealing unsightly objects such as piles 11 beneath the dock 10 while converting the space outboard of the piles to utilitarian space that can be used for the static display of advertising, promotional, pictorial and/or other visual media that serve to convey messages to the public and/or to enhance the beauty of the waterfront.

It will, therefore be appreciated that there have herein been disclosed various types of marine barrier systems which are suitable for use at tidal basin waterfronts or the like or at land-locked waterfronts where water levels remain essentially constant; yet, wherein the barrier system serves to not only conceal unsightly piles, flotsam and other unsightly objects beneath docks or similar man-made waterfront support structures but, additionally, to convert the area outboard of such unsightly structures and objects from wasted space to utilitarian space that can be used for advertising/promotional purposes and/or to simply beautify the waterfront. The system is further characterised by it's simplicity, economy, lack of complex drive mechanisms, and effectiveness.

What is claimed is:

1. A barrier system for use in concealing the above water exposed portions of piles used to support a waterfront structure and for converting the vertical plane outboard of the exposed portions of the piles between the waterline and the level of the waterfront structure supported on the piles to utilitarian space, said barrier system comprising, in combination:

(a) fine mesh screen having upper and lower vertically spaced apart parallel edges;

(b) means for suspending said screen along it's upper edge from the waterfront structure in the region of the upper ends of the piles and outboard thereof; and, (c) means for maintaining said lower edge of said screen in the same vertical plane containing said upper edge of said screen with said lower edge of said screen adjacent to the waterline so that said screen effectively conceals the piles from visual observation while simultaneously presenting a surface for display of graphic media.

2. A barrier system as set forth in claim 1 further characterized in that said fine mesh screen comprises stainless steel wire cloth.

3. A barrier system as set forth in claim 1 further characterized in that said fine mesh screen has graphic media affixed to the outboard surface thereof.

4. A barrier system as set forth in claim 1 further characterized in that: (i) said means for suspending said screen includes a first horizontally disposed roller mounted on the waterfront structure for rotation about a first fixed horizontal axis; (ii) said means for maintaining said screen in the same vertical plane containing said upper edge of said screen includes a second horizontally disposed roller mounted on the piles adjacent the waterline for rotation about a second fixed horizontal axis; (iii) said screen comprises an endless screen trained about said first and second rollers; (iv) means drivingly connecting said screen to at least one of said rollers; and (v), means for rotationally driving said at least one of said rollers so as to cause said screen to move about said first and second rollers so as to change the outboard surface area of said screen that is visually observable above the waterline.

5. A barrier system as set forth in claim 4 further characterized in that said fine mesh screen comprises stainless steel wire cloth.

6. A barrier system as set forth in claim 4 further characterized in that said fine mesh screen has graphic media affixed to the outboard surface thereof.

7. A barrier system as set forth in claim 1 further characterized in that: (i) said means for suspending said screen includes an horizontally disposed roller mounted on the waterfront structure for rotation about a fixed horizontal axis; (ii) said means for maintaining said screen in the same vertical plane containing said upper edge of said screen includes: (a) first and second vertically oriented cable-like elements secured at their upper ends to the waterfront structure at the opposite ends of said roller and intersecting said fixed horizontal axis; (b) means for anchoring the lower ends of said cable-like elements so that said elements are fixedly maintained parallel to one another and in a vertical plane; (c) a transverse, horizontal, rod-like support fixedly secured to said lower edge of said screen; and (d), eyelet defining means projecting axially from the opposite ends of said rod-like support and surrounding said cable-like elements for guiding said screen and maintaining said screen in a vertical plane; and, wherein said barrier system further includes: (iii) bouyant flotation gear secured to said rod-like support; (iv) first means for biasing said roller in a first rotational direction about said axis so as to tend to roll said screen upwardly and about said roller; and (v), second means for biasing said roller in the opposite rotational direction about said axis so as to tend to unroll said screen from said roller, and wherein said first and second biasing means and said bouyant flotation gear are selected such that said screen is constantly maintained in a state of bouyant balance whereby said screen automatically rolls upwardly around said roller during incoming tides and automatically rolls downwardly off of said roller during outgoing tides.

8. A barrier system as set forth in claim 7 further characterized in that said first biasing means includes a pulley secured to one end of said roller, means defining a line fixed secured to said pulley at one end, and a first weight secured to the free end of said line defining means; and, said second biasing means includes a second weight suspended from and secured to said flotation gear.

9. A barrier system as set forth in claim 7 further characterized in that said fine mesh screen comprises stainless steel wire cloth.

10. A barrier system as set forth in claim 7 further characterized in that said fine mesh screen has graphic media affixed to the outboard surface thereof.

11. A barrier system for use in concealing the above water exposed portions of piles used to support a waterfront structure and for converting the vertical plane outboard of the exposed portions of the piles between the waterline and the level of the waterfront structure supported on the piles to utilitarian space, said barrier system comprising, in combination:

(a) first transverse support;

(b) means for securing said first transverse support to the waterfront structure in the region of and outboard of the upper ends of the piles;

(c) a second transverse support parallel to and spaced vertically below said first transverse support;

(d) means for maintaining said second transverse support in a vertical plane containing said first transverse support and at a level immediately above the waterline; and, (e) a fine mesh screen supported by and depending from said first transverse support and having it's lower transverse edge secured to said second transverse support whereby said fine mesh screen lies in a vertical plane outboard of the piles and effectively conceals the portions of the piles above the waterline from visual observation while simultaneously presenting an outboard surface for display of graphic media.

12. A barrier system as set forth in claim 11 further characterized in that said fine mesh screen comprises stainless steel wire cloth.

13. A barrier system as set forth in claim 11 further characterized in that said fine mesh screen has graphic media affixed to the outboard surface thereof.

14. A barrier system as set forth in claim 11 further characterized in that: (i) said first transverse support includes a first roller mounted on the waterfront structure for rotation about a first axis; (ii) said second transverse support includes a second roller mounted on the piles; (iii) said screen comprises an endless screen trained about said first and second rollers; and, wherein (iv) means are provided for drivingly connecting said screen to at least one of said rollers; and (v), means are provided for rotationally driving said at least one of said rollers for changing the visually observable outboard surface of said screen.

15. A barrier system as set forth in claim 14 further characterized in that said fine mesh screen comprises stainless steel wire cloth.

16. A barrier system as set forth in claim 14 further characterized in that said fine mesh screen has graphic media affixed to the outboard surface thereof.

17. A barrier system as set forth in claim 11 further characterized in that: (i) said first transverse support includes a roller mounted on the waterfront structure for rotation about a first axis; (ii) said second transverse support includes a rod-like element; (iii) said means for maintaining said second transverse support in a vertical plane containing said first transverse support and at a level immediately above the waterline includes: (a) first and second vertically oriented cable-like elements secured at their upper ends to the waterfront structure at the opposite ends of said roller and intersecting said first axis; (b) means for anchoring the lower ends of said cable-like elements so that said elements are fixedly maintained parallel to one another and in a vertical plane; (c) eyelet defining means projecting axially from the opposite ends of said second transverse support and surrounding said cable-like elements for guiding said screen and maintaining said screen in a vertical plane; and (d), bouyant flotation gear secured to said second transverse support; and, wherein said barrier system further includes: (iv) first biasing means for biasing said roller in a first rotational direction about said axis so as to tend to roll said screen upwardly and about said roller; and (v), second means for biasing said roller in the opposite rotational direction about said axis so as to tend to unroll said screen from said roller, said first and second biasing means and said bouyant flotation gear being selected such that said screen is constantly maintained in a state of bouyant balance whereby said screen automatically rolls upwardly around said roller during incoming tides and automatically rolls downwardly off of said roller during outgoing tides.

18. A barrier system as set forth in claim 17 further characterized in that said first biasing means includes a pulley secured to one end of said roller, means defining a line fixedly secured to said pulley at one end, and a first weight secured to the free end of said line defining means; and, said second biasing means comprises a second weight suspended from and secured to said flotation gear.

19. A barrier system as set forth in claim 17 further characterized in that said fine mesh screen comprises stainless steel wire cloth.

20. A barrier system as set forth in claim 17 further characterized in that said fine mesh screen has graphic media affixed to the outboard surface thereof.

21. The method of concealing unsightly piles and the like used to support waterfront structures and for simultaneously establishing a vertically oriented surface for display of graphic media outboard of the unsightly piles comprising the steps of:

(a) applying graphic media to one surface of a fine mesh screen;

(b) suspending the screen from a horizontally disposed roller mounted on the waterfront structure outboard of the piles and adjacent to the upper ends thereof with the graphic media disposed on the outboard surface of the screen;

(c) securing the lower free edge of the screen to buoyant flotation gear;

(d) biasing the roller with first biasing means for rotation about it's horizontal axis in a first direction tending to roll the screen upwardly onto and about the roller;

(e) biasing the roller with second biasing means for rotation about it's horizontal axis in the opposite direction tending to unroll the screen downwardly off of the roller; and, (f) balancing the biasing forces exerted by the first and second biasing means so that the first and second biasing means in conjunction with the buoyant flotation gear maintain the screen in a state of buoyant balance whereby the screen rolls upwardly onto and about the roller on incoming tides and downwardly off the roller on outgoing tides so as to continuously vary the area of graphic media visually observable on the outboard surface of the screen.

22. The method of concealing unsightly piles and the like used to support waterfront structure and for simultaneously establishing a vertically oriented surface for display of graphic media outboard of the unsightly piles as set forth in claim 21 wherein the fine mesh screen comprises stainless steel wire cloth.

* * * * *